US007651454B2

(12) United States Patent
Reymond et al.

(10) Patent No.: US 7,651,454 B2
(45) Date of Patent: Jan. 26, 2010

(54) BRAILLE PRINTING DEVICE

(75) Inventors: Jacques Reymond, Gland (CH); Roberto Valterio, Ollon (CH); Christian Butty, Corcelles-Sur-Chavornay (CH)

(73) Assignee: BOBST S.A. (CH)

( * ) Notice: Subject to any disclaimer, the term of this patent is extended or adjusted under 35 U.S.C. 154(b) by 0 days.

(21) Appl. No.: 11/948,202

(22) Filed: Nov. 30, 2007

(65) Prior Publication Data

US 2008/0146428 A1 Jun. 19, 2008

(30) Foreign Application Priority Data

Dec. 14, 2006 (EP) ..... 06025936

(51) Int. Cl.
*B41F 13/54* (2006.01)

(52) U.S. Cl. ..... 493/321; 493/322; 493/58; 434/114

(58) Field of Classification Search ..... 493/321, 493/322, 337, 58, 64, 66; 434/114, 113; 400/427, 127, 129, 132; 101/31, 32
See application file for complete search history.

(56) References Cited

U.S. PATENT DOCUMENTS 2,039,406 A * 5/1936 Greensfelder ..... 358/401
2,565,608 A * 8/1951 Hoff ..... 101/3.1
3,132,962 A * 5/1964 Seymour ..... 434/113
3,267,191 A * 8/1966 Williams et al. ..... 264/166
3,510,967 A * 5/1970 Bruce et al. ..... 434/114
3,598,042 A * 8/1971 Boyd ..... 101/163
3,823,804 A * 7/1974 Lokey ..... 400/109.1
3,882,207 A * 5/1975 Hannan et al. ..... 264/1.33
4,022,643 A * 5/1977 Clark ..... 156/78
4,108,066 A * 8/1978 Andersson ..... 101/22
4,126,400 A * 11/1978 Suzuki et al. ..... 400/144.2
4,183,683 A * 1/1980 Hiratsuka et al. ..... 400/109.1
4,261,663 A * 4/1981 Grimnes ..... 400/109.1
4,389,126 A * 6/1983 Honma et al. ..... 400/82
4,444,519 A * 4/1984 Howell et al. ..... 400/82
4,500,293 A * 2/1985 Eltgen ..... 434/114
4,557,778 A * 12/1985 Held ..... 156/209
4,653,942 A * 3/1987 Soloveychik et al. ..... 400/109.1
5,449,240 A * 9/1995 Dorpfeld et al. ..... 400/127
5,589,021 A * 12/1996 Bloom ..... 156/219
5,753,350 A * 5/1998 Bright ..... 428/195.1

(Continued)

FOREIGN PATENT DOCUMENTS

DE 20 2005 017869 7/2006

(Continued)

OTHER PUBLICATIONS

European Search Report dated May 31, 2007 issued in corresponding European Patent Appln. No. EP 06 02 5936.

*Primary Examiner*—Sameh H. Tawfik
(74) *Attorney, Agent, or Firm*—Ostrolenk Faber LLP

(57) ABSTRACT

Device for printing Braille characters on cardboard blanks travelling in a folder-gluer along a substantially planar path, the device comprising rotary embossing tools carried by two respective parallel shafts rotatably mounted above and below of the plane of said path and operable for printing Braille characters on their blanks during their run through the folder-gluer. The tools are supported on shafts and the tools are adjustable axially and angularly with respect to each other.

14 Claims, 7 Drawing Sheets

U.S. PATENT DOCUMENTS

| | | | | |
|---|---|---|---|---|
| 5,762,597 | A * | 6/1998 | Valterio | 493/423 |
| 5,853,360 | A * | 12/1998 | Jeffrey et al. | 493/178 |
| 6,315,110 | B1 * | 11/2001 | Reymond et al. | 198/809 |
| 6,718,871 | B1 * | 4/2004 | Fritz | 101/3.1 |

FOREIGN PATENT DOCUMENTS

| | | |
|---|---|---|
| EP | 0 140 163 | 5/1985 |
| FR | 2 821 290 | 8/2002 |
| WO | WO 2006/077134 | 7/2006 |

* cited by examiner

BRAILLE PRINTING DEVICE

TECHNICAL FIELD

The present invention concerns a device for printing Braille characters on cardboard blanks.

The invention also concerns a folder-gluer comprising a frame carrying means for conveying blanks along a substantially planar path.

The invention also concerns a rotary embossing tool for printing Braille characters on cardboard blanks.

BACKGROUND ART

In order to comply with some regulations regarding information directed to partially sighted or blind people, it became necessary to print Braille messages on certain packaging and boxes, in particular on medicine packaging. The Braille printing process consists of pressing or embossing a surface of the box to reveal points in relief (or protrusions) allowing tactile reading of the messages.

It is already known to print Braille messages when converting a cardboard sheet in a flatbed diecutting press (or platen press) to form blanks ready to be processed by a folder-gluer so as to subsequently form packaging boxes.

A platen press works a in sequential manner (or discontinuously), i.e. the sheets passing through the press are stopped before each converting operation. In contrast, a folder-gluer works uninterruptedly, i.e. the blanks passing through the folder-gluer are processed during their continuous advance in the machine.

The productivity for obtaining packaging boxes from cardboard sheets will be called global productivity, it is the combination of the productivity of a platen press and a folder-gluer.

Usually, the Braille characters printing is achieved using an embossing tool in the shape of a plate mounted on a platen of the platen press. Like every tool of a platen press, assembly of the embossing tool requires long and fine adjustments, thereby reducing the productivity of the platen press and thus the global productivity. This drawback increases with the number of embossing tools mounted on a same platen.

Moreover, in background art, the embossed blanks which leave a platen press are to be fed into a folder-gluer. The folder-gluer is fed by a feeder having a function of feeding the folder-gluer blank by blank from a stack of blanks. In a stack of embossed blanks, the protrusions tend to nest into each other so that it is difficult to separate the blanks as they are fed. Nevertheless, if a blank manages to leave the stack, the protrusions of said blank are crushed by the stack, thus reducing the legibility of the Braille messages.

Another drawback related to the prior art is the difficulty in printing a Braille message close to an edge or close to a crease of the blank. Indeed, the cutting, creasing and embossing tools are held on the same platen by tool supports which require a certain space. Because of this space requirement, the approaching of the tools is limited.

SUMMARY OF THE INVENTION

An object of the present invention is to avoid the above drawbacks by proposing Braille printing which does not affect the global production of packaging boxes, which facilitates the separation of the blanks of a printed stack, which improves the legibility of the Braille messages and which offers more freedom in the positioning of the messages on the box.

To this end, the invention concerns a device for printing Braille characters on cardboard blanks travelling in a folder-gluer.

Owing to this new design, the global productivity of packaging boxes is improved. In fact, due to the absence of embossing tools in the platen press, time usually needed for the assembly and the adjustment of the tools is saved. The presence of an embossing tool in the folder-gluer is without impact on the global productivity because there is only one embossing tool to be assembled and adjusted. Moreover, the assembly and the adjustment of the tool can be made during converting operation of the platen press.

Another advantage of the invention is the easy separation of the blanks of a stack. Indeed, the blanks fed into the folder-gluer are not embossed so that there are no protrusions to nest into each other. Moreover, owing to this feature, protrusions are not crushed in the feeder of the folder-gluer. Thus, the legibility of the Braille messages is improved.

Another advantage of the invention is the possibility of printing Braille messages anywhere on the blank, in particular close to an edge or close to a creasing of the blank, since the embossing tool works on a blank already converted by a platen press.

Another object of the invention is to provide a rotary embossing tool for printing Braille characters on cardboard blanks in a folder-gluer.

Other features and advantages of the invention will be more clearly understood from the description of embodiments which refers to the accompanying drawings.

DESCRIPTION OF A PREFERRED EMBODIMENT OF THE INVENTION

In the following description, the left side and the right side of the folder-gluer are to be considered with respect to the transport direction of the cardboard blanks, shown by arrow F. Similarly, the plane of the path F is defined as the horizontal plane passing along the longitudinal axis of the folder-gluer. The elements located above the plane of the path F are called upper and the elements located below the plane of the path F are called lower.

Figure 1:
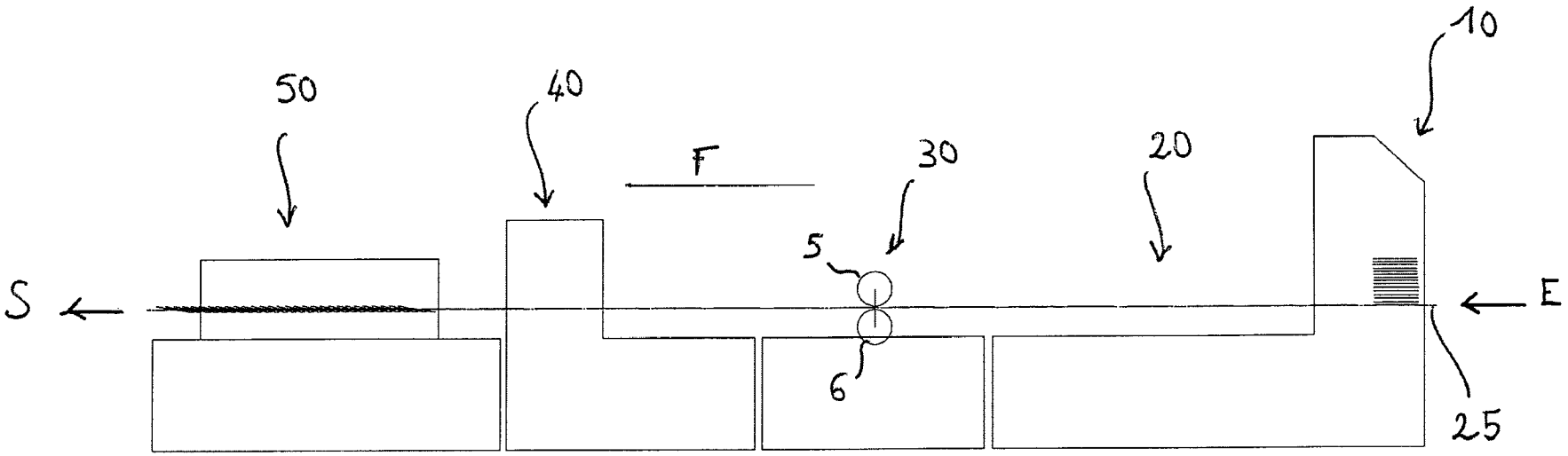
FIG. 1 is a schematic view of a folder-gluer according to the invention, as seen from the left side with respect to the transport direction of the cardboard blanks.

FIG. 1 illustrates a folder-gluer according to the invention. In the example, the cardboard blanks enter the folder-gluer by the inlet E and are collected in the form of folded boxes at the outlet S. The folder-gluer comprises successively from the inlet E to the outlet S, a feeder 10, a prebreaking module 20, a module 30 called <<Braille module>>, a folding module 40 and a delivery station 50. The Braille module 30 is defined by its function in the folder-gluer. The function of the Braille module 30 is to print Braille characters on the cardboard blanks travelling in the folder-gluer. This function is new in a folder-gluer.

Figure 2:
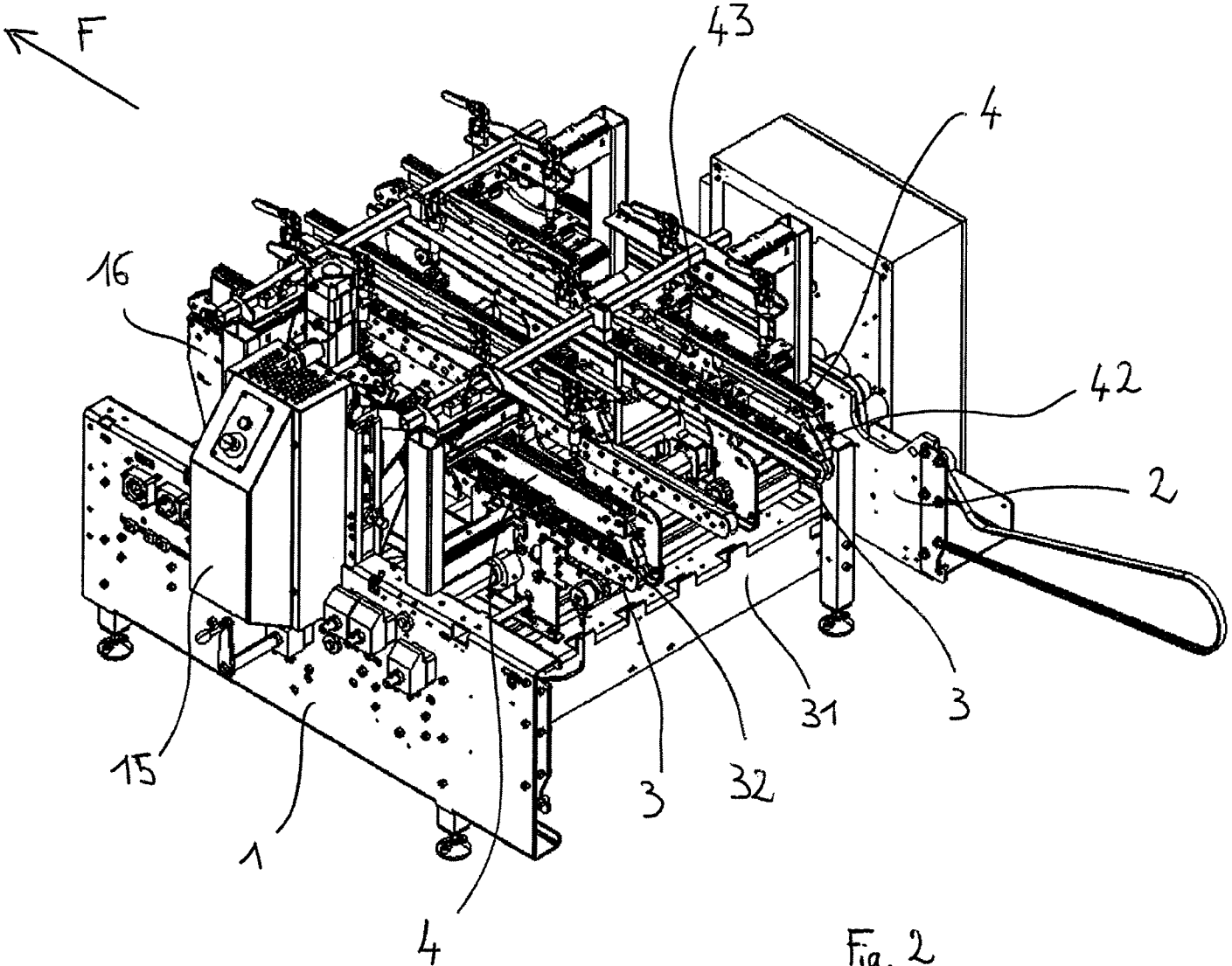
FIG. 2 is a perspective view of a detail of FIG. 1 referring to the Braille module.

FIG. 2 illustrates an embodiment of the Braille module. To achieve the function of the Braille module, the folder-gluer according to the invention comprises a main frame primarily formed by two vertical, left and right parts, respectively 1 and 2, maintained apart from one another by a plurality of separating pieces 31 (see FIG. 2). The folder-gluer according to the invention also comprises means 3, 4 for conveying the cardboard blanks along a substantially planar path F and a device 15 connected to the main frame, for printing Braille characters on the cardboard blanks travelling in the folder-gluer. The device 15 is the device according to the invention, and is described separately.

FIG. 2 also illustrates an example of a mechanism for horizontal transport of the blanks. In this example, the transport mechanism is carried by a frame 16 arranged between the left 1 and right parts 2 of the main frame. The frame 16 is movable transversely so that it can be moved closer to or moved apart from the left 1 and right parts 2. The frame 16 comprises a lower conveyor 3 and an upper conveyor 4. Each conveyor 3, 4 includes a respective endless conveying belt 32, 42. As these two conveyors 3, 4 are similar, only one of them is described. The conveying belt 42 of the upper conveyor 4 is guided by a plurality of upper rollers 43 and frictionally driven by the conveying belt 32 of the lower conveyor 3. The upper rollers 43 are directly mounted on the upper conveyor 4.

Each conveyor 3, 4 comprises rollers arranged in a plane corresponding to the transport path F of the cardboard blanks. On the upper conveyor 4, the rollers forming the planar transport parts are grouped in a plurality of bogies subjected to elastic pressure means (not shown) for pressing the conveying belts 32, 42 against one another.

Figure 3:
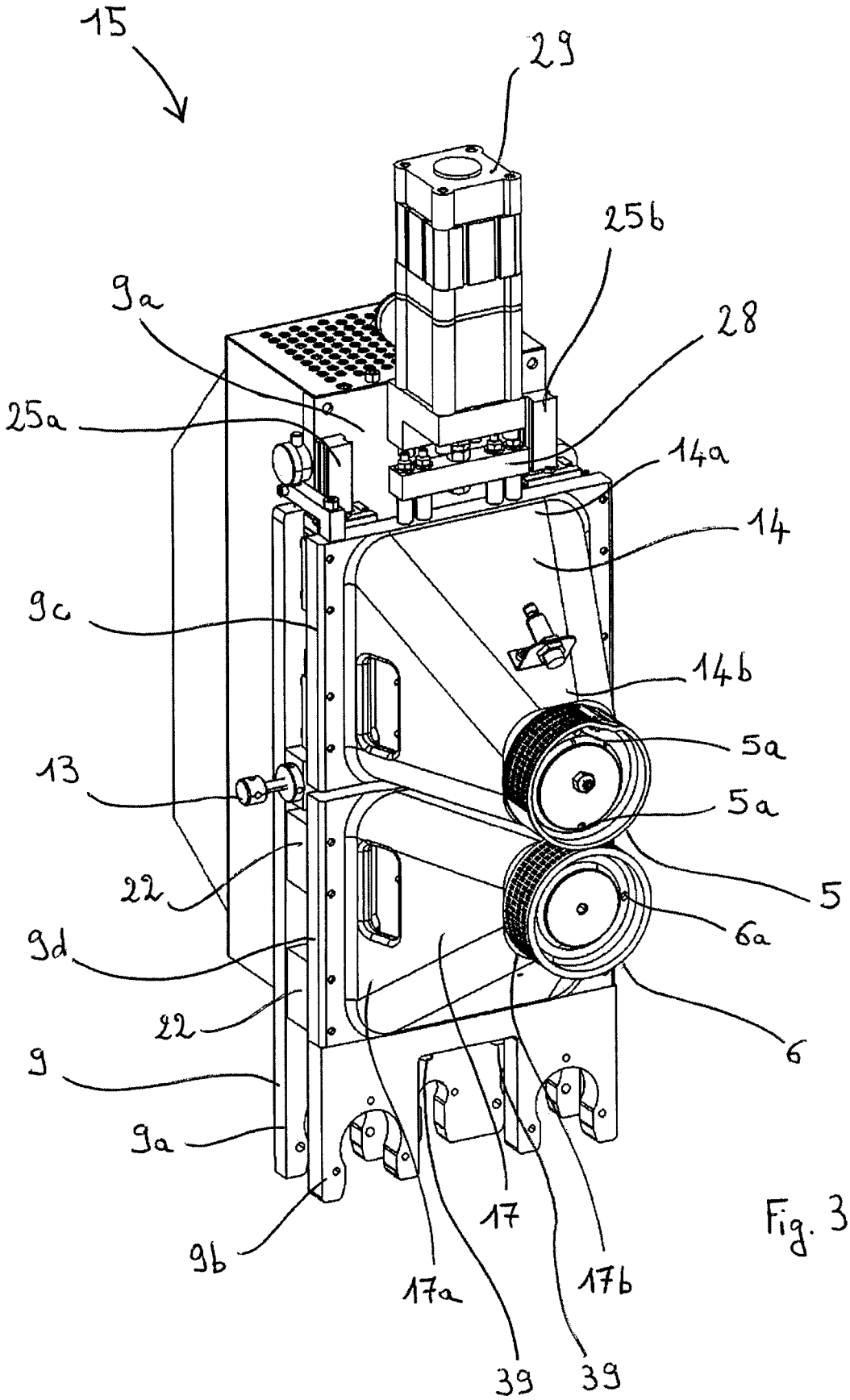
FIG. 3 is a perspective view of the device according to the invention, as seen from left inside with respect to the transport direction of the cardboard blanks.

FIG. 3 illustrates an embodiment of a device according to the invention. The device 15 includes a cradle 9 comprising two respective parallel walls 9*a*, 9*b*, 9*c*, 9*d* held apart from one another by separating pieces 22. The wall 9*b*, 9*c*, 9*d* consists of a lower wall 9*b*, 9*d* and an upper wall 9*c*. The lower wall 9*b*, 9*d* consists of a first lower wall 9*b* extended by a second lower wall 9*d*. The lower wall 9*b* is secured to the second lower wall 9*d* owing to screws 39 extending through the edge of the walls. In order to connect the device 15 to the main frame, the left part 1 of the frame can be enclosed between the walls 9*a* and 9*b* by means of screws and nuts (not shown). Alternatively, the device 15 can be movably mounted on transverse shafts so that it can be moved apart from or moved closer to the transport mechanism. The transverse shafts are mounted between the left 1 and right parts 2 of the main frame and an opening is provided in the left part 1 of the frame so that, in a distant position, the device 15 partly extends through the left part 1 of the frame. The device 15 includes a rotatable upper 5 and lower rotary embossing tool 6.

Figure 4:
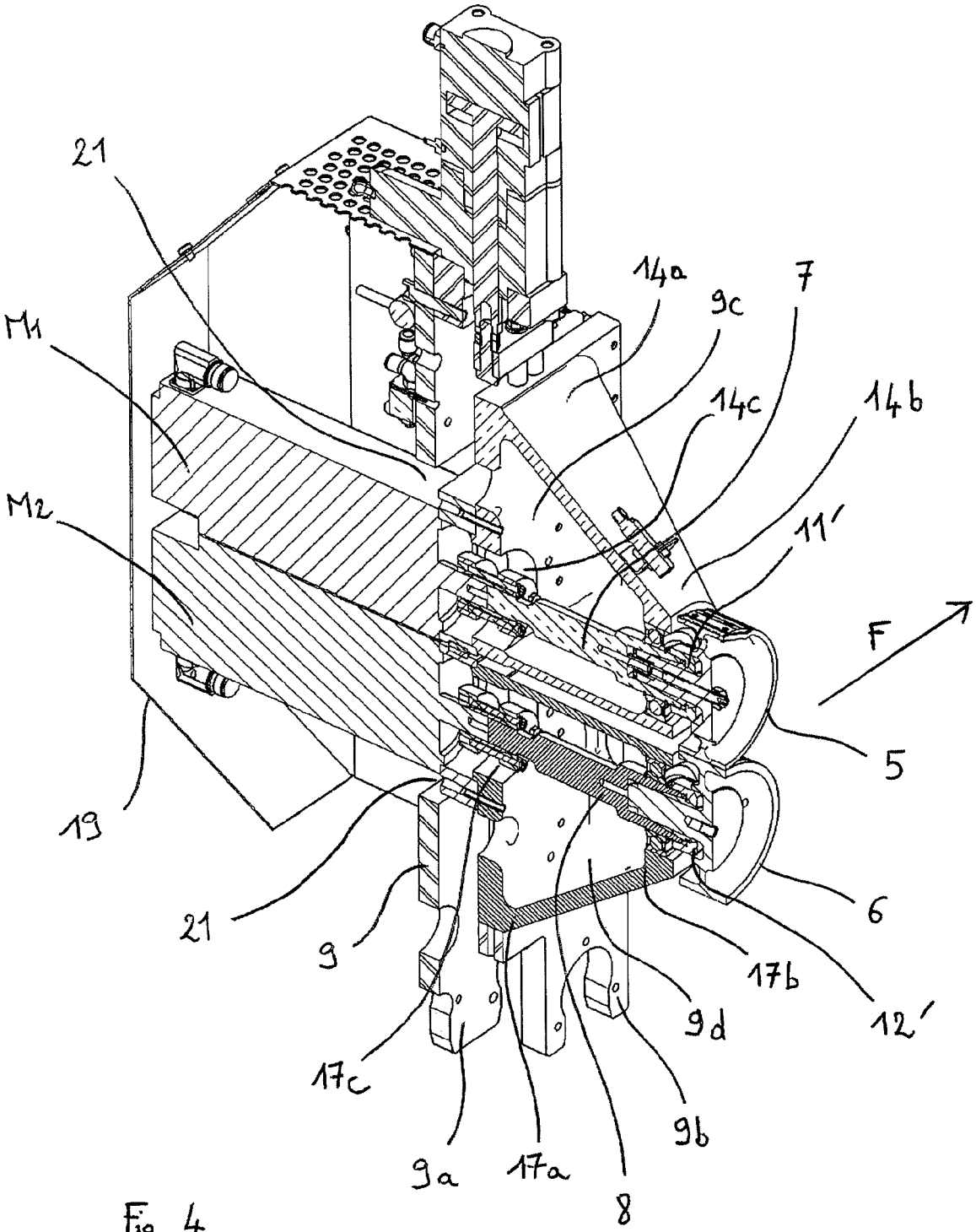
FIG. 4 is a section of the perspective view of FIG. 3.

As can be seen in FIG. 4, each tool 5, 6 is mounted on a respective tool-holder shaft 7, 8. The two shafts 7, 8 are parallel to one another and cantilevered mounted on the cradle 9, so that in other words, each of the two shafts 7, 8 has a free end which is not supported. The tools 5, 6 are mounted at the free end of said respective shafts 7, 8. Since the shafts do not extend through the entire width of the main frame for leaning on the right part 2 of the main frame, means for limiting the bending of the shafts 7, 8 is to support them close to their free end. For this purpose, support casings 14,17 are provided on the cradle. Each casing 14,17 has the general shape of a hollow truncated cone. Advantageously, the wall 9*c* of the cradle forms the base 14*a* of the cone 14, a hole 14*c* is provided at the base 14*a* of the cone to let the tool-holder shaft 7 pass therethrough. Likewise, the wall 9*d* of the cradle forms the base 17*a* of the cone 17, a hole 17*c* is provided at the base 17*a* of the cone to let the tool-holder shaft 8 pass therethrough. The top 14*b* of the cone 14 receives a ball bearing 23 for supporting the shaft 7 close to its free end, and the top 17*b* of the cone 17 receives a ball bearing 24 for supporting the shaft 8 close to its free end. Thus, the casings 14, 17 allow to limit the bending of the shafts 7, 8 while protecting them from outside. Owing to these arrangements, the tools 5, 6 can be easily mounted on their respective tool-holder shaft 7, 8. For this purpose, each respective parallel shaft 7, 8 comprises at its free end tightening means for attaching the respective rotary embossing tools 5, 6 to said shafts.

Advantageously, each tightening means consists of a biconical clamp 11,12. To attach the tools 5, 6 to their respective shaft 7, 8, each tool 5, 6 has a respective axial rod 5*b*, 6*b* (see detail FIG. 6) introduced into a respective boring 7*a*, 8a provided at the free end of the respective axes 7, 8. For securing the tools 5, 6, nuts 11', 12' of the respective biconical clamps 11, 12 are screwed on an external portion of the respective shafts 7, 8. The screwing of the nuts 11', 12' pushes on respective conical rings 11*a*, 12*b* connected to the respective rods 5*b*, 6*b*. The inlet of each boring 7*a*, 8*a* being conical, thus the form co-operation between the conical rings 11*a*, 12*a* and the respective borings 7*a*, 8*a* clamps the respective rods 5*b*, 6*b*, in other words blocks the respective tools 5, 6.

Moreover, each tool-holder shaft 7, 8 is connected to a synchronous drive motor M1, respectively M2. The motors M1, M2 are mounted opposite the respective tools 5, 6, on the rear of the upper 9*c*, respectively lower wall 9*d*. A covering cap 19 mounted on the rear of the wall 9*a* protects the motors. The front of the wall 9*a* is defined as being the face of the wall 9*a* turned towards the tools 5, 6, the rear of the wall being the face opposite the front. This definition also applies to the wall 9*c*, 9*d*. An opening 21 in the wall 9*a* allows the passage of the motors M1, M2. The motors M1, M2 are fixed on the rear of the upper 9*c*, respectively lower wall 9*d*, by respective fastening bolts 26*a*, 27*a*. Each motor M1, M2 has a respective flange 26, 27 (see FIG. 5) in planar support against the rear of the upper 9*c*, respectively lower wall 9*d*. The fastening bolts 26*a*, 27*a* extend through the respective flanges 26, 27 in order to screw into the upper 9*c*, respectively lower wall 9*d*.

Advantageously, the spacing of the tools 5, 6 can be adjusted. Due to this arrangement, the device according to the invention can be used with cardboard blanks of different thickness. To this end, the casing 14 is mounted vertically movable on sliding rails 25*a*, 25*b* fixed on the front of the wall 9*a* (see FIG. 3). The vertical position of the casing 14 can be adjusted with an adjustment screw device 13.

Figure 9:
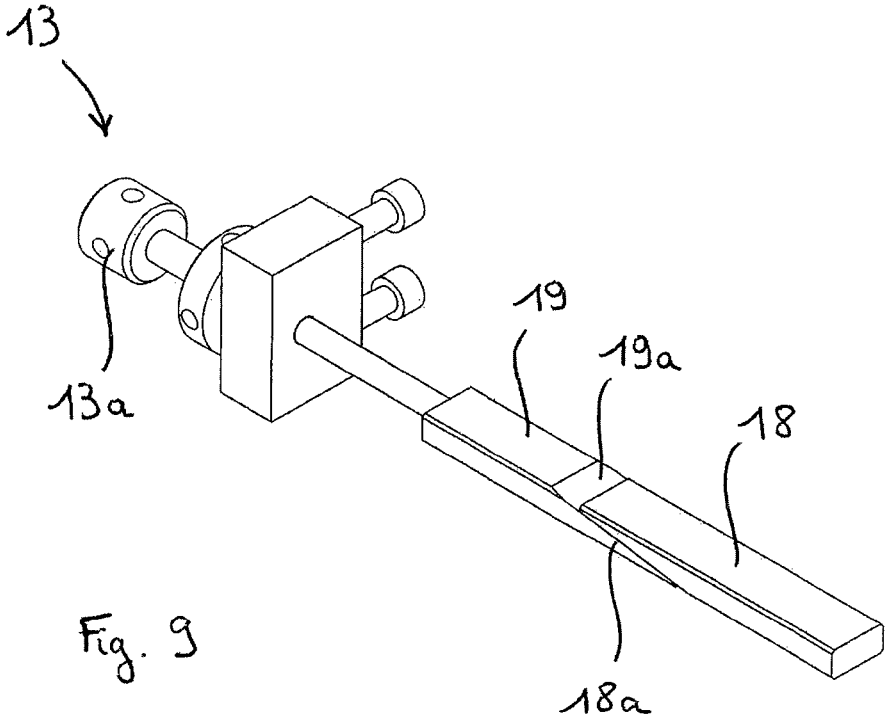
FIG. 9 is a perspective view of the tools for adjusting the vertical position of the upper tool of the device according to the invention.

A known example of adjustment screw device is illustrated in FIG. 9. In this example, the adjustment screw device 13 comprises two beveled wedges 18, 19 arranged horizontally and cooperating by their respective slanted face 18*a*, 19*a*. The wedge 19 is attached to the end of a horizontal screw 13 whereas a knurled button 13*a* is mounted at the other end of said screw. When turning the knurled button 13*a*, the screw 13 drives the wedge 19 in translation along the axis of the screw. During this movement, the wedge 18 being fixed in horizontal translation and free movable in vertical translation, the slanted face 19*a* of the wedge 19 slides under the slanted face 18*a* of the wedge 18, causing the vertical movement of the wedge 18.

Figure 5:
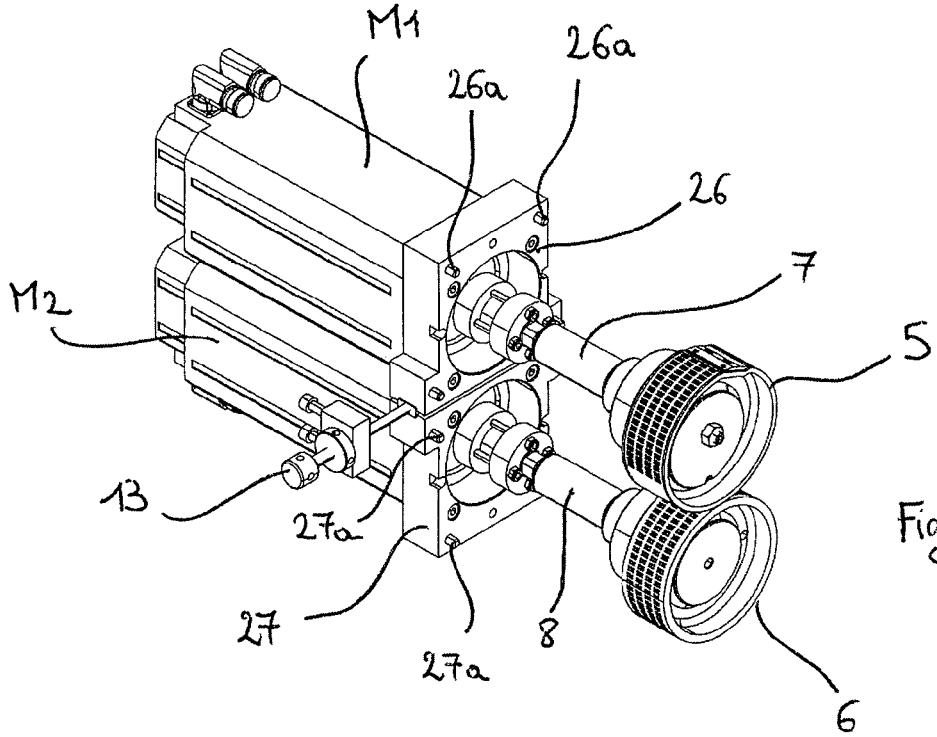
FIG. 5 is a perspective view of a detail of FIG. 4 showing the adjustment means of the tools according to the invention.

FIG. 5 illustrates an example of use of the adjustment screw device previously described. Since the wedge 19 can slide in a horizontal groove provided at the top of the flange 27 and the wedge 18 is screwed on the base of the flange 26, the rotation of the knurled button 13*a* moves the tool 5 vertically. In this example, the lower tool 6 is fixed, in another embodiment, the upper tool 5 can be fixed and the lower tool 6 can be movable.

Advantageously, the vertically movable casing 14 can move upwards against a spring track 28 (see FIG. 3). Owing to this feature, the tools 5, 6 are not damaged by an extra thickness of the cardboard. In fact, if the thickness of a cardboard blank is greater than the thickness adjusted by the adjustment screw device 13, the vertical force applied by the blank onto the tool 5 is transferred to the casing 14 by means of the ball bearing 23 and the attachment points of the motor M1 to the upper wall 9*c*. This vertical force pushes the casing 14 against the spring track 28. By compressing, the springs 28 let the casing 14 rise along the vertical slides 25*a*, 25*b* so that the tool 5 moves apart from the tool 6.

Advantageously, a pneumatic cylinder 29 is mounted on the wall 14 vertically to the casing 14, the free end of the rod of the cylinder 29 is connected to the casing 14. In the position where the cylinder rod is retracted, the casing 14 is drawn upwards so that the tool 5 moves apart from the tool 6. When the device according to the invention is stopped, the rod of the cylinder 29 is retracted.

Before starting a job of Braille printing, the tools 5, 6 must be correctly positioned one with respect to the other, on their respective shaft 7, 8. To this end, means for angular adjustment 33 and axial adjustment 35 are provided.

Figure 7:
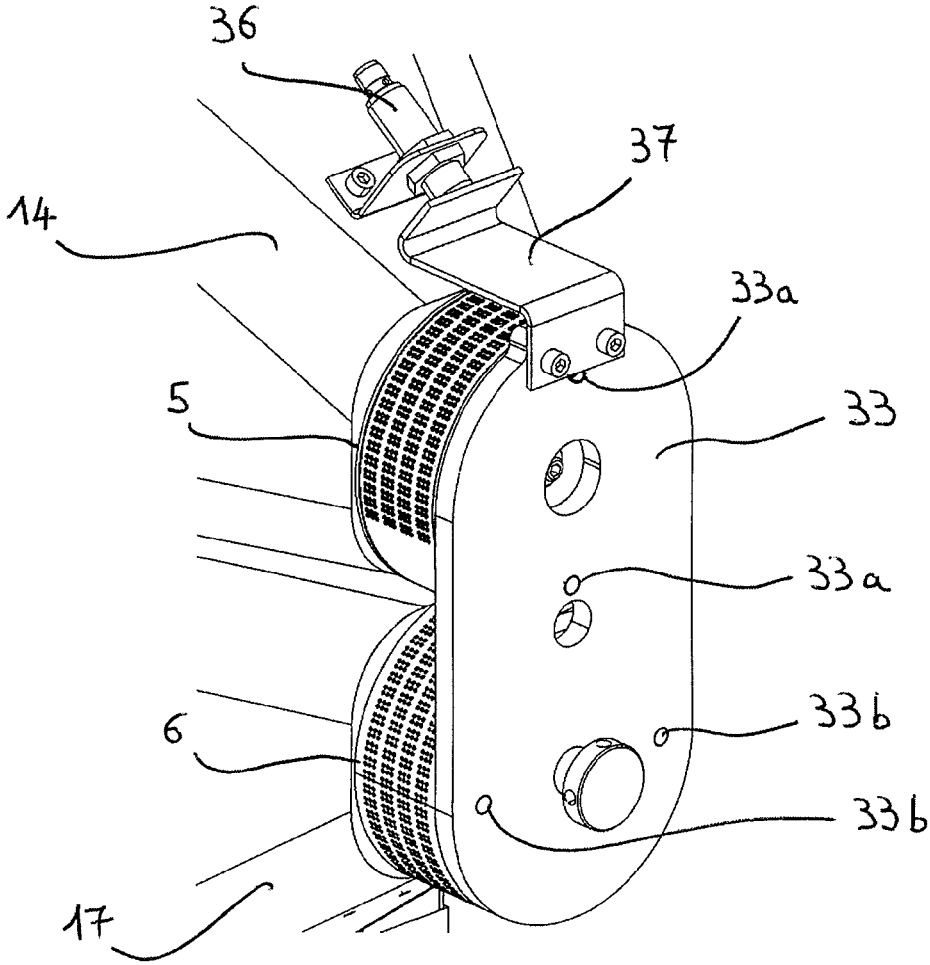
FIG. 7 is a perspective view of the means for angular adjustment of the tools according the invention.

FIG. 7 illustrates an example of means for angular adjustment. In this example, an elongated plate 33 is provided with two respective pairs of pins (or needles) 33*a*, 33*b* placed at given places of said plate. Each tool 5, 6 has a respective pair of holes 5*a*, 6*a* (see FIG. 3). By matching up the holes 5*a*, 6*a* with the respective pins 33*a*, 33*b*, the tools 5*a*, 6*a* are in a given angular position and are synchronized. This given angular position is recorded in a computer (not shown) and continuously followed by two pulse generators connected to the respective synchronous drive motors M1, M2 (not shown). Thus, any drift of the angular position of the tools 5, 6 can be adjusted in the course of production.

Advantageously, the plate 33 is extended with a tongue 37 ready to cooperate with a sensor 36 mounted on the casing 14. Owing to this arrangement, it can be checked that the angular adjustment was indeed made and that the plate 33 was indeed withdrawn before starting the production. In fact, if the plate 33 is not positioned before starting the production, the sensor 36 does not detect the presence of the tongue 37, in other words the sensor 36 is deactivated. This information is sent to the computer which informs the operator via a control screen or any other interface. Likewise, if the angular adjustment was indeed made but the plate 33 is not withdrawn, the sensor 36 remains active. This information is sent to the computer which stops the production and informs the operator. In the example, the sensor 36 is of the induction type.

Figure 6:
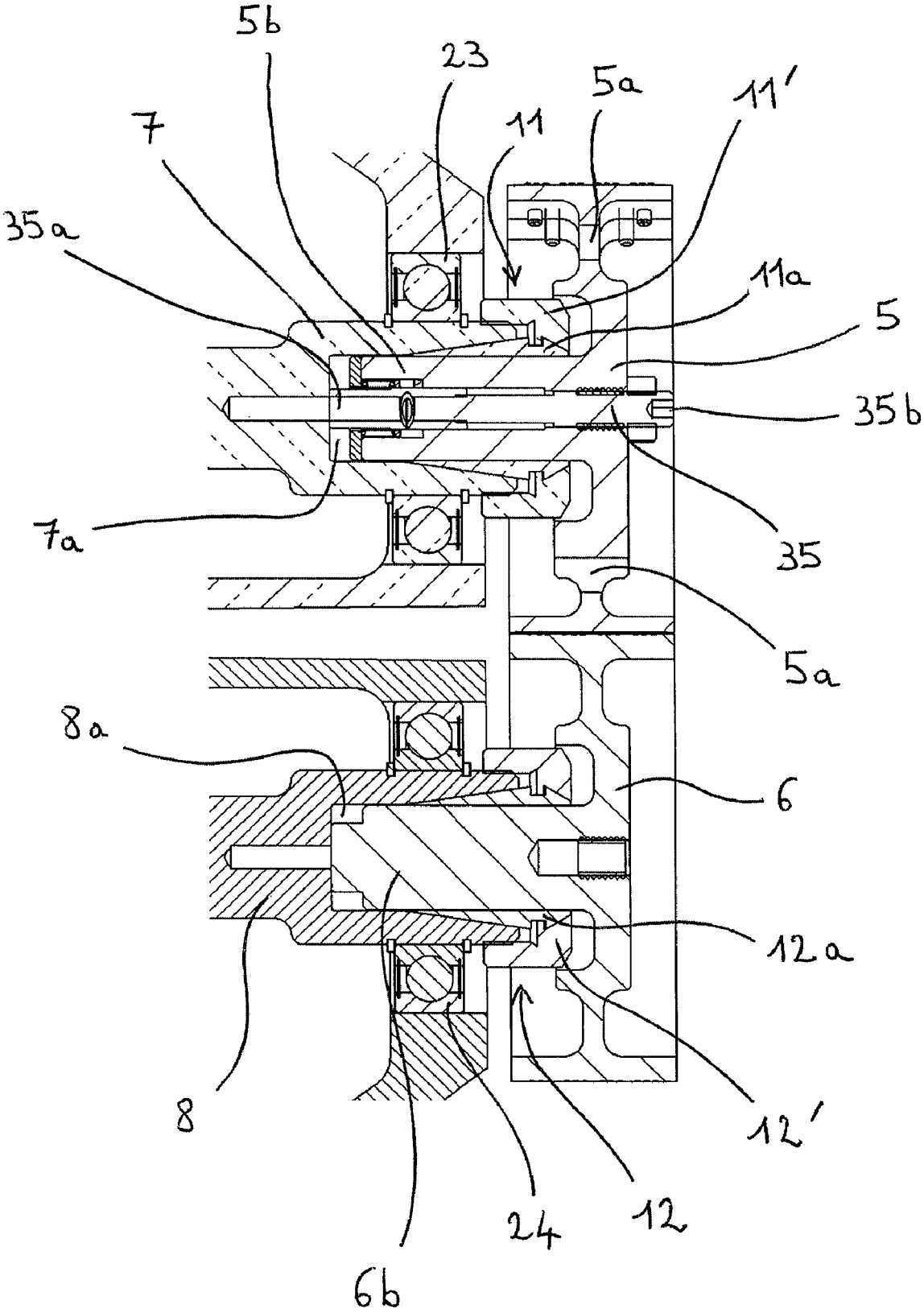
FIG. 6 is e sectional view of a detail of FIG. 4 showing the tightening means of the tools according to the invention.

FIG. 6 illustrates an example of means for axial adjustment. The axial rod 5*b* of the tool 5 is crossed by an axial hole wherein a screw 35 is introduced. The end opposite the screw head 35*b* emerges from the rod 5*b* and rests against the bottom of the boring 7*a*. The rotation of the screw head 35*b* lengthens or narrows the emerging portion 35*a* of the screw 35. Owing to this feature, it is possible to axially move the tool 5 on its shaft 7 and thus to axially match up the tools 5, 6.

Figure 8:
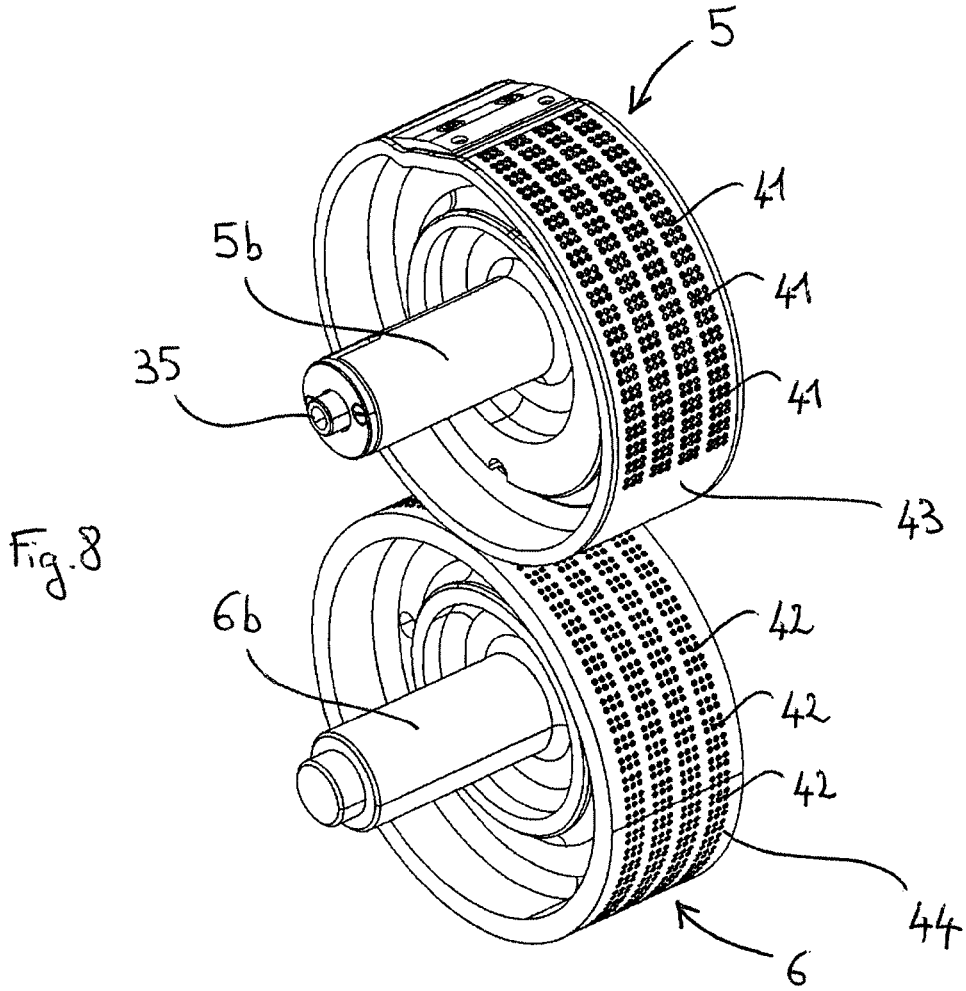
FIG. 8 is a perspective view of the tools according to the invention.

FIG. 8 shows an example of tools according to the invention. The tools 5, 6 include a rotary male embossing tool 5 and a rotary female embossing tool 6. The male tool 5 consists of a cylinder whose peripheral surface is strewn with pins (or protrusions) 41. The female tool 6 consists of a cylinder whose peripheral surface is strewn with hollows (or depressions) 42. When printing, the pins 41 penetrate the thickness of the cardboard so as to form Braille characters. Each cylindrical tool 5, 6 comprises in its center a respective axial rod 5*b*, 6*b*. A screw 35 crosses the axial rod.

Advantageously, the pins 41 and the hollows 42 are carried by a respective metal plate 43, 44 wound on the respective cylindrical tool 5, 6.

The operation and use of the described device are the following: for printing Braille characters on cardboard blanks, a first work is to choose the tools 5, 6 according to the message to be printed. Then, the tools 5, 6 are mounted on their respective shaft 7, 8 and positioned angularly by the means 33 and axially (or transversely referring to the transport direction F of the blanks) by the means 35. Next, the tools 5, 6 are fixed by means of the respective biconical clamps 11, 12. Finally, owing to the device 13, the spacing of the tools 5, 6 is adjusted in accordance with the thickness of the cardboard to be processed. This adjustment also allows to accurately and simultaneously adjust the penetration depth of the pins 41 of the tool 5.

It can be noted from the above description that the device according to the invention is adaptable to a range of dimensions and types of extremely broad cardboard blanks and that the adjustment operations are simple to carry out.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

The invention claimed is:

1. A folder gluer apparatus for processing blanks with Braille characters, the apparatus comprising:

a printing apparatus for printing the blanks to be printed with the Braille characters;

a blank guide device for guiding the blanks through the folder gluer apparatus along a planar path past the printing apparatus;

the printing apparatus comprising a pair of rotary embossing tools having opposing embossing surfaces, and the guide device directing the blank between the opposing surfaces of the embossing tools, the embossing tools being shaped and positioned so as to each contact a respective surface of the blank passing between the embossing tools;

a pair of parallel shafts, each shaft of the pair of shafts positioned for each of the rotary embossing tools and configured so that each rotary embossing tool rotates on the respective shaft;

a folder and a gluer mechanism positioned downstream of the printing apparatus and along the path of the blanks through the folder gluer apparatus, the folder and gluer mechanism configured to fold and to glue the blanks so that the Braille characters are accessible with the blanks folded and glued; and wherein one shaft of the pair of shafts is movable in translation with respect to the other shaft of the pair of shafts in a direction perpendicular to the planar path of the blanks.

2. The apparatus of claim 1, further comprising a cradle positioned in the folder gluer, and each shaft of the pair of shafts is cantilever mounted on the cradle.

3. The apparatus of claim 2, wherein each of the shafts comprises a free end and a tightening device positioned on each free end, the tightening device being operable to tighten the rotary embossing tool on the shaft.

4. The apparatus of claim 3, wherein the tightening device comprises a biconical clamp.

5. The apparatus of claim 1, wherein the blank guide device includes a conveyor positioned and operable to convey the blanks along the planar path through the folded gluer apparatus and past the embossing tools.

6. The apparatus of claim 5, wherein the conveyor comprises an upper conveyor positioned above the blanks and a lower conveyor positioned below the blanks.

7. The apparatus of claim 1, wherein the folded gluer apparatus includes a frame positioned and configured to secure the printing apparatus.

8. The apparatus of claim 7, wherein the printing apparatus is movable transversely of the frame and with respect to the planar path of the blanks through the folded gluer apparatus.

9. The folded gluer of claim 1, wherein the printing apparatus is positioned within the folded gluer apparatus on the planar path of the blanks upstream of the folder and gluer mechanism.

10. The folded gluer of claim 1, wherein the embossing tools comprise a male tool comprised of a cylinder with a peripheral surface including pins formed thereon and a female tool comprised of a cylinder with a peripheral surface including hollows positioned and configured to receive the pins.

11. A folder gluer apparatus for processing blanks with Braille characters, the apparatus comprising;

a printing apparatus for printing the blanks to be printed with the Braille characters;

a blank guide device for guiding the blanks through the folder gluer apparatus along a planar path past the printing apparatus;

the printing apparatus comprising a pair of rotary embossing tools having opposing embossing surfaces, and the guide device directing the blank between the opposing surfaces of the embossing tools, the embossing tools being shaped and positioned so as to each contact a respective surface of the blank passing between the embossing tools;

a pair of shafts, each shaft of the pair of shafts positioned for each of the rotary embossing tools and configured so that each rotary embossing tool rotates on the respective shaft;

a folder and a gluer mechanism positioned downstream of the printing apparatus and along the path of the blanks through the folder gluer apparatus, the folder and gluer mechanism configured to fold and to glue the blanks so that the Braille characters are accessible with the blanks folded and glued;

further comprising a pair of synchronous drive motors, each motor operable to drive to rotate a shaft of the pair of shafts.

12. A folder gluer apparatus for processing blanks with Braille characters, the apparatus comprising:

a printing apparatus for printing the blanks to be printed with the Braille characters;

a blank guide device for guiding the blanks through the folder gluer apparatus along a planar path past the printing apparatus;

the printing apparatus comprising a pair of rotary embossing tools having opposing embossing surfaces, and the guide device directing the blank between the opposing surfaces of the embossing tools, the embossing tools being shaped and positioned so as to each contact a respective surface of the blank passing between the embossing tools;

a pair of shafts, each shaft of the pair of shafts positioned for each of the rotary embossing tools and configured so that each rotary embossing tool rotates on the respective shaft;

a folder and a gluer mechanism positioned downstream of the printing apparatus and along the path of the blanks through the folder gluer apparatus, the folder and gluer mechanism configured to fold and to glue the blanks so that the Braille characters are accessible with the blank folded and glued;

further comprising an angular adjustment device connected with the embossing tools and operable to angularly position the tools with respect to each other on the respective shaft.

13. The apparatus of claim 12, further comprising an axial adjustment device operable for axially positioning the rotary embossing tools with respect to each other along the respective shaft.

14. A folder gluer apparatus for processing blanks with Braille characters, the apparatus comprising:

a printing apparatus for printing the blanks to be printed with the Braille characters;

a blank guide device for guiding the blanks through the folder gluer apparatus along a planar path past the printing apparatus;

the printing apparatus comprising a pair of rotary embossing tools having opposing embossing surfaces, and the guide device directing the blank between the opposing surfaces of the embossing tools, the embossing tools being shaped and positioned so as to each contact a respective surface of the blank passing between the embossing tools;

a pair of shafts, each shaft of the pair of shafts positioned for each of the rotary embossing tools and configured so that each rotary embossing tool rotates on the respective shaft;

a folder and a gluer mechanism positioned downstream of the printing apparatus and along the path of the blanks through the folder gluer apparatus, the folder and gluer mechanism configured to fold and to glue the blanks and so that the Braille characters are accessible with the blanks folded and glued;

an axial adjustment device operable for axially positioning the rotary embossing tools with respect to each other along the respective shaft.

* * * * *